US005832564A

United States Patent [19]

Shanok

[11] Patent Number: 5,832,564

[45] Date of Patent: Nov. 10, 1998

[54] HANDLE EXTENSION BASE FOR SECUREMENT TO A REFRIGERATOR DOOR

[75] Inventor: William Shanok, New York, N.Y.

[73] Assignee: Silvatrim Associates, South Plainfield, N.J.

[21] Appl. No.: 904,790

[22] Filed: Aug. 1, 1997

Related U.S. Application Data

[60] Continuation-in-part of Ser. No. 573,069, Dec. 15, 1995, Pat. No. 5,659,927, which is a division of Ser. No. 353,627, Dec. 12, 1994, Pat. No. 5,493,756.

[51] Int. Cl.[6] ..... A47B 95/02

[52] U.S. Cl. ..... 16/110 R; 16/125; 16/111 R

[58] Field of Search ..... 16/110 R, 111 R, 16/125, 114 R, DIG. 19, DIG. 5, DIG. 40, DIG. 41, DIG. 116 R, 124; 312/244, 405

[56] References Cited

U.S. PATENT DOCUMENTS 3,995,349 12/1976 Roberts et al. ..... 16/125

4,745,656 5/1988 Revlett ..... 16/110 R 4,926,526 5/1990 Carlson et al. ..... 16/125

*Primary Examiner*—Chuck Mah

*Attorney, Agent, or Firm*—Goodman & Teitelbaum, Esqs.

[57] ABSTRACT

A refrigerator door handle including handle extension bases on opposite sides thereof for securement to a refrigerator door for receiving associated handle extensions of the refrigerator door handle, each handle extension base having a longitudinally extending body member with one end of the body member being closed by two arms extending inwardly towards each other, where each arm has a tab provided on an inner side thereof. An edge portion of the body member at the one end thereof is bent upwardly to a raised position so that the raised edge portion provides a recess thereunder for receiving the tabs therein. The free ends of the arms are secured together, and also the tabs are secured to an under surface of the raised edge portion in order to close the one end of the body member. In a modified embodiment, a transverse slit is provided through the raised edge portion of the body member to facilitate the upward bending of the raised edge portion.

6 Claims, 3 Drawing Sheets

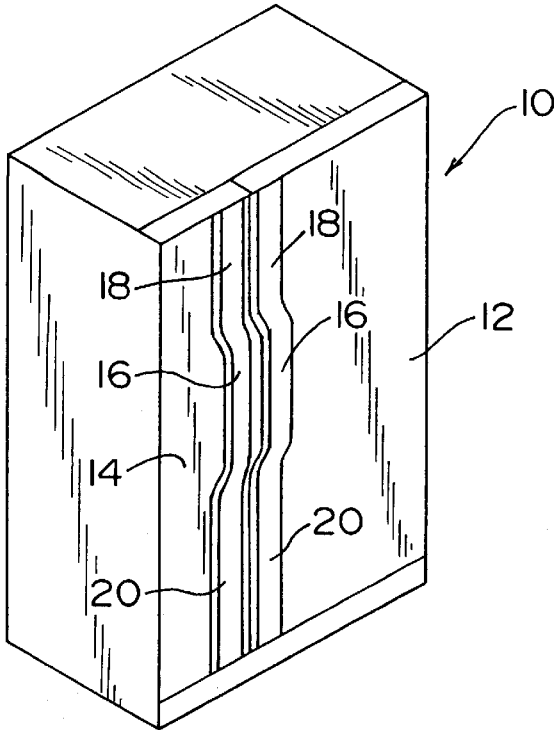
FIG. 1
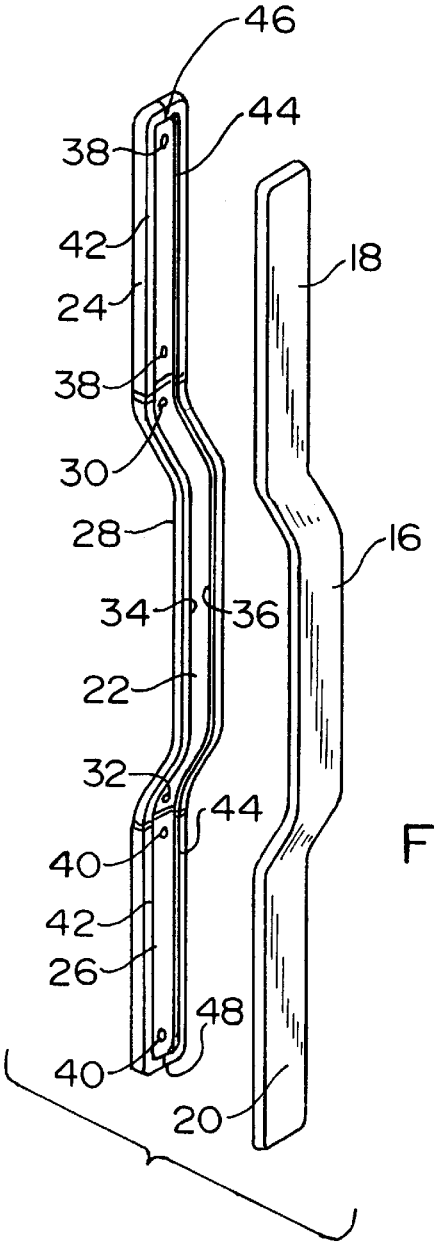
FIG. 2
FIG. 3
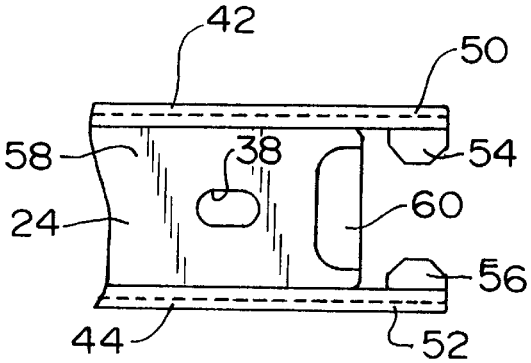
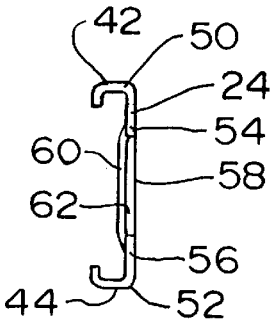
FIG. 4

HANDLE EXTENSION BASE FOR SECUREMENT TO A REFRIGERATOR DOOR

CROSS-REFERENCE TO RELATED APPLICATIONS

This is a continuation-in-part of co-pending application Ser. No. 08/573,069, filed Dec. 15, 1995, now U.S. Pat. No. 5,659,925 which is a division of application Ser. No. 08/353,627, filed Dec. 12, 1994, now U.S. Pat. No. 5,493,756, dated Feb. 27, 1996.

BACKGROUND OF THE INVENTION

The invention relates to a refrigerator door handle, and more particularly, to a handle extension base which is secured to a refrigerator door for receiving an associated handle extension of the refrigerator door handle, and specifically to the structure and method used to close one end of the handle extension base.

Refrigerator door handles are well known in the prior art, being produced by using cast or stamped metal parts which are mechanically fixed. Accordingly, these prior art refrigerator door handles require extensive labor costs in the assembly thereof, where a large number of mechanical attachment devices are joined together, all of which frequently produce a refrigerator door handle having unsightly seams at the joint points of the extensions of the handle, and also unsightly injection molded end caps or metal stamped end caps at the outermost extensions of these parts, such as the handle extension bases. Thus, in general, most of the prior art refrigerator door handles do not provide a smooth, clean appearance on the refrigerator door.

Patent application Ser. No. 08/353,627, now U.S. Pat. No. 5,493,756, discloses an initial attempt to provide structure and method for closing one end of the handle extension base in order to reduce the number of parts required for same, such as the unsightly injection molded end caps or metal stamped end caps at the outer extensions of these parts, and thus to eliminate the unsightly seams at the joint points at these outermost extensions of the handle.

However, even with the disclosure in the above U.S. Pat. No. 5,493,756, there is still presently a need for a refrigerator door handle which reduces the number of parts required for the assembly and securement thereof so as to reduce the labor costs in connection therewith, and which also eliminates the requirement of unsightly end caps at the outermost extensions thereof, and which further eliminates the unsightly seams at the joining points thereof between the handle and extensions.

SUMMARY OF THE INVENTION

It is, accordingly, an object of the present invention to provide an extruded plastic handle having handle extensions on opposite ends thereof for association with handle extension bases for securement to a refrigerator door, which avoids the problems and disadvantages of the prior art devices.

Another object of the present invention is to provide a refrigerator door handle including handle extension bases having closed outer end portions.

A further object of the present invention is to provide a refrigerator door handle including handle extension bases, where an end of each base is cut to provide two arms extending outwardly therefrom.

Still another object of the present invention is to provide a refrigerator door handle having handle extension bases as mentioned above, where each of the arms has a tab provided on an inner side thereof.

Yet another object of the present invention is to provide a refrigerator door handle including handle extension bases as mentioned above, where an edge portion of the base at the one end thereof is bent upwardly to a raised position to provide a recess thereunder for receiving the tabs therein.

Another object of the present invention is to provide a refrigerator door handle having handle extension bases as mentioned above, where the raised edge portion on the base is provided with a transverse slit therethrough to facilitate the the upward bending of the raised edge portion.

Still a further object of the present invention is to provide a refrigerator door handle having handle extension bases which can be easily and inexpensively manufactured and assembled together, and which can be simply and quickly installed on the refrigerator door.

Briefly, in accordance with the present invention, there is provided a refrigerator door handle including handle extension bases on opposite sides thereof, which are secured to a refrigerator door for receiving associated handle extensions of the refrigerator door handle. Each handle extension base has a longitudinally extending body member where one end of the body member is closed by two arms extending inwardly towards each other, each arm having a tab provided on an inner side thereof. An edge portion of the body member at the one end thereof being bent upwardly to a raised position so that the raised edge portion provides a recess thereunder for receiving the tabs therein. The free ends of the arms are secured together, and also the tabs are secured to an under surface of the raised edge portion in order to close the one end of the body member. In a modified embodiment, a transverse slit is provided through the raised edge portion of the body member to facilitate the upward bending of the raised edge portion.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 1 is a perspective view of a refrigerator provided with extended plastic handles having handle extensions on opposite ends thereof;

FIG. 2 is an exploded perspective view of one of the plastic handles of FIG. 1, showing the handle extension bases according to the present invention;

FIG. 3 is a fragmented top plan view of an end portion of one of the handle extension bases shown in FIG. 2;

FIG. 4 is a right end view of the handle extension base shown in FIG. 3;

In the various figures of the drawings, like reference characters designate like parts.

DESCRIPTION OF THE PREFERRED EMBODIMENTS

Figure 5:
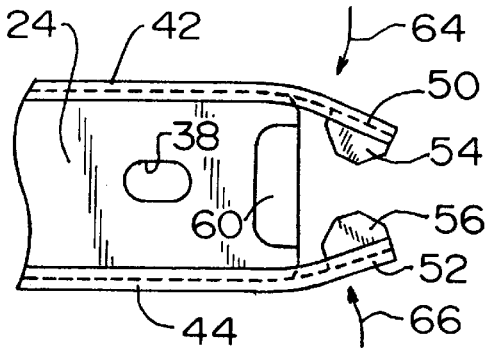
FIG. 5 is a fragmented top plan view similar to the showing in FIG. 3, where the arms of the handle extension base are being bent towards each other.

Referring now to the drawings, FIG. 1 shows a side-by-side refrigerator 10 having two conventional doors, a refrigerator door 12 and a freezer door 14. Each of the doors 12, 14 are provided with an identical extruded plastic handle cover 16 having upper and lower handle extensions 18, 20, respectively, on opposite ends thereof, similar to the showing in U.S. Pat. No. 5,493,756. Accordingly, in that both handle covers 16 and handle extensions 18, 20 thereof are identical, only the handle cover 16 and the handle extensions 18, 20 on the refrigerator door 12 will be discussed in detail below.

FIG. 2 is an exploded view to show that the handle cover 16 and handle extensions 18, 20 enclose a conventional pull handle 22 and longitudinally extending upper and lower handle extension bases 24, 26 provided at opposite longitudinal ends of the pull handle 22 in an abutting arrangement therewith. Preferably, the pull handle 22 has a raised mid-section 28 to permit a user's fingers to grip thereunder. Holes 30, 32 are provided in the opposite end portions of the pull handle 22 to receive conventional screws therein for securing the pull handle 22 to the outer surface of the refrigerator door 12. Preferably, longitudinal extending reinforcement ribs 34, 36 are provided on the upper surface of the pull handle 22.

Each of the handle extension bases 24, 26 is provided with pairs of holes 38, 40, respectively, to receive conventional screws to secure the handle extension bases 24, 26 to the outer surface of the refrigerator door 12 in a longitudinal alignment with the pull handle 22. The handle extension bases 24, 26 have opposing flanged side edges 42, 44, where the upper and lower end portions 46, 48 are closed. Up to this point, the structure described above is discussed in U.S. Pat. No. 5,493,756 to which reference may be made, where the present invention is directed to he closed end portions 46, 48 of the handle extension bases 24, 26. Accordingly, in that both handle extension bas 24, 26 are identical, only upper handle extension base 24 will be discussed in detail below.

Accordingly, after the plastic handle extension base 24 is extruded, it is cut to a predetermine longitudinal length as required for each particular refrigerator door. Thereafter, or during the cutting thereof, one end of the handle extension base 24 is die cut to form extending arms 50, 52 on opposite sides thereof, as shown in FIGS. 3 and 4. Each of the arms 50, 52 has a tab 54, 56, respectively, formed on the inner side thereof so that the air of tabs 54, 56 extend outwardly towards each other. It is noted, that the tabs 54, 56 are cut from the longitudinally extending base portion 58 of the handle extension bas 24. Furthermore, adjacent to the cut-out area, an edge portion 60 of the base portion 58 is bent or mechanically drawn upwardly to a raised position between the flanged side edges 42, 44 to form a recess 62 thereunder for receiving the tabs 54, 56 therein as set forth below.

Figure 6:
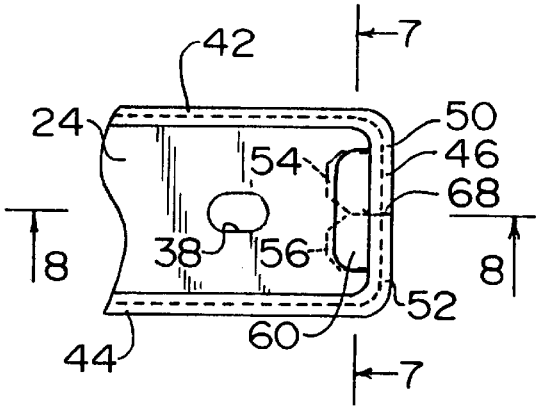
FIG. 6 is a fragmented top plan view similar to FIG. 5, showing the finished end portion of the handle extension base.
Figure 7:
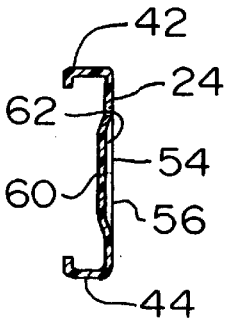
FIG. 7 is a cross-sectional view taken along line 7—7 of FIG. 6.
Figure 8:
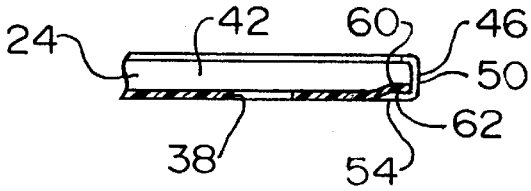
FIG. 8 is a cross-sectional view taken along line 8—8 of FIG. 6.

Thereafter, the arms 50, 52 are bent inwardly towards each other in the direction of arrows 64, 66 as shown in FIG. 5, so that the free ends of the arms 50, 52 abut against each other at seam 68, as shown in FIG. 6. During this procedure, the side edges of the tabs 54, 56 also are brought into abutment with each other so that the tabs 54, 56 fill the recess 58 as best shown in FIGS. 7 and 8. The seam 68 between the abutting ends of the arms 50, 52, as well as the tabs 54, 56, are fixedly secured in position to form a joint area at the end portion 46 of the handle extension base 24 by sonic welding, or any other suitable securement means such as adhesive bonding, heat sealing, or mechanical means, including the decorative staples, rivets and the like, which are well known in the art. Thus, the end portion 46 is closed, where obviously the same procedure is followed for the end portion 48 of the lower handle extension base 26.

It is noted, that in the prior art joint area at the end portion of the handle extension base disclosed in U.S. Pat. No. 5,493,756, only the abutting surface forming the horizontal and vertical seams are secured together. However, in the present invention, in addition to the seam 68 between the abutting ends of the arms 50, 52, as well as in addition to the abutting surface between the tabs 54, 56, in is noted that the upper surface of the tabs 54, 56 are secured to the under surface of the raised edge portion 60 so that the engagement or joint area is substantially increased over that disclosed in the prior art for an improved securement therebetween. It is further noted, that in order to better bend or mechanically draw the edge portion 60 of the base portion 58 upwardly without tearing, breaking or fracturing same, it is desirable to first cut a slot through the edge portion 60, as set forth below.

Figure 9:
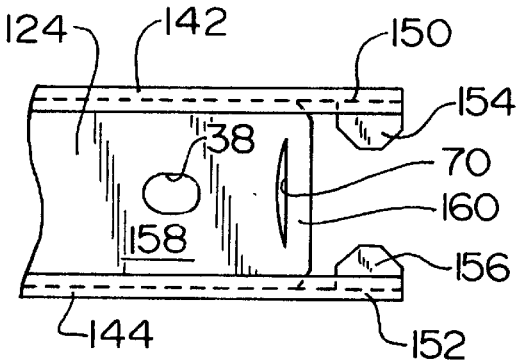
FIG. 9 is a fragmented top plan view similar to FIG. 3, showing a modified end portion of the handle extension base.
Figure 10:
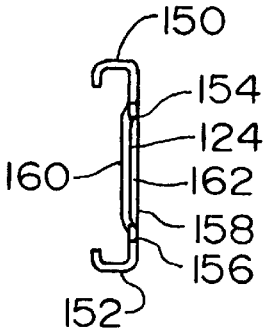
FIG. 10 is a right end view of the handle extension base shown in FIG. 9.
Figure 11:
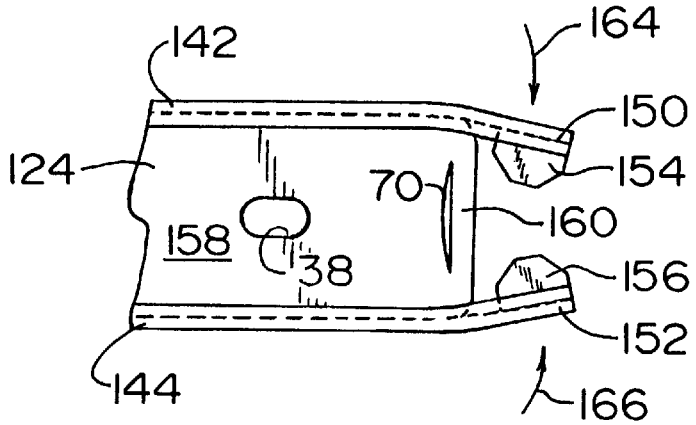
FIG 11 is a fragmented top plan view similar to the showing in FIG. 5, where the arms of the handle extension base of FIG. 9 are being bent towards each other.

FIGS. 9 and 10 show a modified end of a handle extension base 124 which is substantially similar to the above mentioned end of the handle extension base 24 shown in FIGS. 3 and 4. Accordingly, extending arms 150, 152 are formed in the same manner as above by die cutting the end of the handle base 124. Each of the arms 150, 152 has a tab 154, 156, respectively, formed thereon to be the same as the above mentioned tabs 54, 56.

However, a transverse slit 70 is cut through the base portion 158 in alignment with and adjacent to the cut edge of the base portion 158. Thereafter, the edge portion 160 of the base portion 158 is easily bent or mechanically drawn upwardly to a raised position between the flanged side edges 142, 144 to form a recess 162 for receiving the tabs 154, 156, as best shown in FIG. 10, as set forth below.

Figure 12:
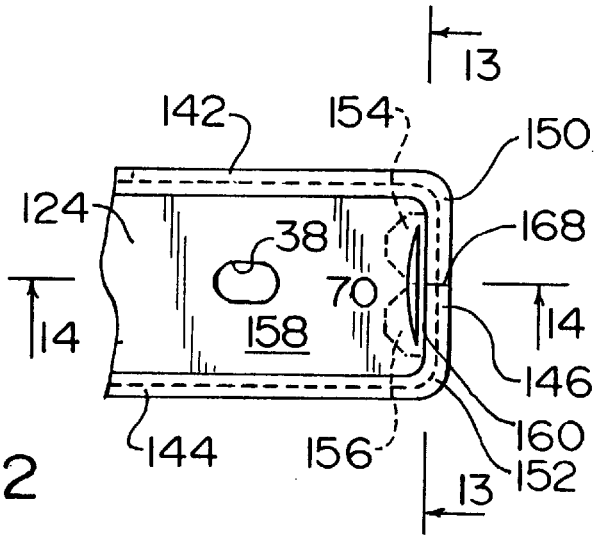
FIG. 12 is a fragmented top plan view similar to FIG. 6, showing the finished modified end portion of the handle extension base of FIG. 9.
Figure 13:
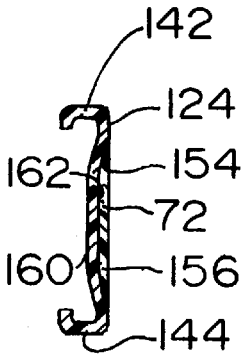
FIG. 13 is a cross-sectional view taken along line 13—13 of FIG. 12.
Figure 14:
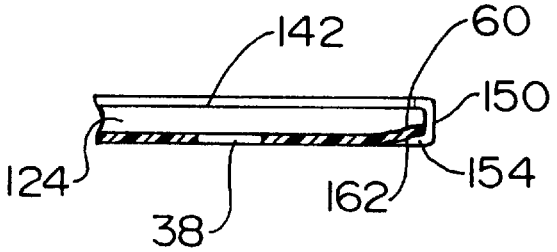
FIG. 14 is a cross-sectional view taken along line 14—14 of FIG. 12.
Figure 15:
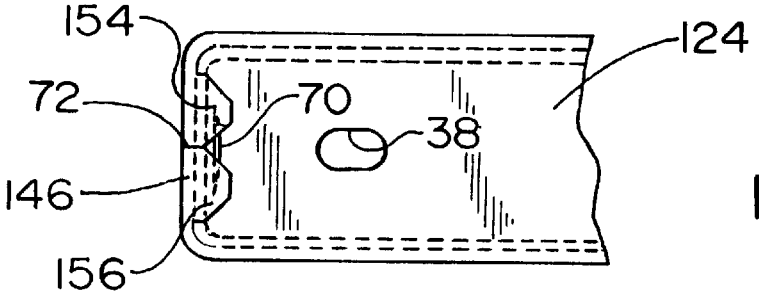
FIG. 15 is a fragmented bottom plan view of the finished modified end portion of the handle extension base shown in FIG. 12.

Here again, the arms 150, 152 are bent inwardly towards each other in the direction of the arrows 164, 166 so that the free ends of the arms 150, 152 abut against each other at seam 168, as shown in FIG. 12. Accordingly, the side edges of the tabs 154, 156 are also brought into abutment with each other at seam 72, so that the tabs 154, 156 fill the recess 162 as best shown in FIGS. 13 and 14. The seam 168 between the abutting ends of the arms 150, 152, as well as the seam 72 between the tabs 154, 156 as best shown in FIG. 15, are fixedly secured in position to form a joint area at the end portion 146 of the handle extension base 124.

Additionally, the securement means also secures the upper surfaces of the tabs 154, 156 to the under surface of the raised edge portion 160 as best shown in FIGS. 13 and 14. Preferably, the securement is done by sonic welding or any other suitable securement means as mentioned above, such as adhesive bonding, heat sealing, or mechanical means including decorative staples, rivets and the like, which are well known in the art. Here again, the end portion 146 is closed, where obviously the same procedure can be followed for the end portion 48 of the lower handle extension base 26.

Numerous alternatives of the structure herein disclosed will suggest themselves to those skilled in the art. However, it is to be understood that the present disclosure relates to preferred embodiments of the invention which are for the purpose of illustration only, and are not to be construed as limitations of the invention.

What is claimed is:

1. A handle extension base for securement to a refrigerator door for receiving an associated handle extension of a refrigerator door handle, comprising:

a longitudinally extending body member having a longitudinally extending base portion provided with longitudinally extending side edges on opposite sides thereof to provide a longitudinally extending first recess therebetween;

said body member having an integral one piece construction;

end means for closing one end of said body member, said end means including two arms extending integrally outwardly from opposite end portions of said one end of said body member;

each of said arms having one of a pair of tabs provided on an inner side thereof;

an edge portion of said base portion at said one end of said body member being bent upwardly to a raised position disposed between said side edges so that the raised edge portion provides a second recess thereunder for receiving said pair of tabs therein;

said two arms being bent inwardly toward each other so that free ends of said two arms are positioned facing each other, and said tabs are disposed adjacent to each other within said second recess; and securement means fixedly securing said free ends of said two arms together, and also fixedly securing said tabs to an under surface of said raised edge portion to close said one end of said body member.

2. A handle extension base according to claim 1, wherein a transverse slit is provided through said raised edge portion of said base portion to facilitate the upward bending of said raised edge portion.

3. A handle extension base according to claim 1, wherein holes are provided in said body member so that screws can pass therethrough and be threaded into the refrigerator door.

4. A handle extension base according to claim 1, wherein said securement means includes a sonic welded seam.

5. A handle extension base according to claim 1, wherein said securement means includes an adhesive bonded seam or a heat sealed seam.

6. A handle extension base according to claim 1, wherein said securement means includes a seam secured by staples or rivets.

* * * * *